US005528028A

United States Patent [19]

Chu et al.

[11] Patent Number: 5,528,028

[45] Date of Patent: *Jun. 18, 1996

[54] FREQUENCY STANDARD USING AN ATOMIC STREAM OF OPTICALLY COOLED ATOMS

[76] Inventors: Steven Chu, Department of Physics, Stanford University, Stanford, Calif. 94305-4060; Carl Weiman, University of Colorado, JILA Box 440, Boulder, Colo. 80309; William Swann, 5597 Lefthand Canyon, Jamestown, Colo. 80455

[ * ] Notice: The term of this patent shall not extend beyond the expiration date of Pat. No. 5,338,930.

[21] Appl. No.: 360,851

[22] Filed: Oct. 20, 1994

Related U.S. Application Data

[63] Continuation of Ser. No. 217,893, Mar. 25, 1994, which is a continuation of Ser. No. 983,093, Nov. 24, 1992, Pat. No. 5,338,930, which is a continuation-in-part of Ser. No. 531, 754, Jun. 1, 1990, abandoned, and a continuation-in-part of Ser. No. 561,995, Aug. 2, 1990, abandoned.

[51] Int. Cl.[6] ..... H05H 3/02

[52] U.S. Cl. ..... 250/251

[58] Field of Search ..... 250/251

[56] References Cited

U.S. PATENT DOCUMENTS

| | | | |
|---|---|---|---|
| 3,772,519 | 11/1973 | Levy et al. . | |
| 4,121,178 | 10/1978 | Schlossberg . | |
| 4,122,408 | 10/1978 | Walls . | |
| 4,315,224 | 2/1982 | Ezekiel et al. . | |
| 4,323,860 | 4/1982 | Lieby, Jr. et al. . | |
| 4,331,933 | 5/1982 | Allan et al. . | |
| 4,425,653 | 1/1984 | Cutler . | |
| 4,446,446 | 5/1984 | Fowks . | |
| 4,454,482 | 6/1984 | DeMarchi . | |
| 4,462,006 | 7/1984 | Fowks . | |
| 4,684,900 | 8/1987 | Avila et al. . | |
| 5,338,930 | 8/1994 | Chu et al. | 250/251 |

OTHER PUBLICATIONS

Scientific American, pp. 26, 30–31, Jun. 1990.

"Atomic fountain springs from a light touch", I. Peterson, *Science News,* Aug. 19, 1989.

"Less is more: Experiments with an individual atomic particle at rest in free space", Hans Dehmelt, 58(1) *American Journal of Physics,* pp. 17–27, Jan. 1990.

"Progress Recents Dans Les Etalona Atomiques De Frequence Et Leurs Applications", Pierre Thomann et al., *Societe Suisse De Chronometrie,* Oct. 1983.

"High Resolution Microwave Spectroscopy on Trapped Ba+Ions", W. Becker, R. Blatt and G. Werth, *Precision Measurement and Fundamental Constants II,* B. N. Taylor and W. D. Phillips, Eds., pp. 99–101, 1984.

(List continued on next page.)

*Primary Examiner*—Bruce C. Anderson

*Attorney, Agent, or Firm*—Wigman, Cohen, Leitner & Myers

[57] ABSTRACT

Beams of laser light trap and cool cesium atoms in a small vapor cell and put the atoms in a particular quantum mechanical state. The lasers are then configured so as to launch the atoms upward by shifting the frequencies of the vertically propagating lasers. The atoms pass through a microwave waveguide during both their ascent and descent. The microwave field is applied briefly each time the atoms are in the center of the waveguide so that the microwaves excite the cesium "clock" transition. Once the atoms have fallen back to where they started, the laser fields are turned on in a particular sequence. The fraction of the atoms that make a quantum mechanical transition is measured by observing the laser light scattered by the atoms. That signal indicates how close the microwave frequency is to the atomic transition. The laser cooling reduces the relative motion of the atoms so that the atoms can be observed longer. The resulting atomic resonance measured is much narrower.

38 Claims, 6 Drawing Sheets

OTHER PUBLICATIONS

"Realization and Dissemination of the Second", K. Dorenwendt, 22, *Metrologia,* pp. 186–189, 1986.
"Limitations of Atomic Beam Frequency Standards", London Lewis, *Prog. Quantum Electronics,* vol. 8, pp. 153–159, 1984.
"JPL Trapped Ion Frequency Standard Development", IEEE 41st Annual Frequency Symposium, J. D. Prestage, G. J. Dick and L. Maleki, 1987.
"History of Atomic Clocks", *Journal of Research of the National Bureau of Standards,* Norman F. Ramsey, vol. 88, No. 5, pp. 301–320, Oct. 1983.
Hewlett Packard Model HP 5061B Cesium Beam Frequency Standard Brochure, Jun. 1987.
"Observation of the cesium clock transition in lawer cooled atoms", D. W. Sesko and C. E. Wieman, *Optical Society of America,* pp. 269–271, 1989.
"Light Traps Using Spontaneous Forces", E. E. Pritchard, E. L. Raab and V. Bagnato, *Physical Review Letters,* vol. 57, No. 3, pp. 310–313, Jul. 1986.
"rf Spectroscopy in an Atomic Fountain", Mark A. Kasevich, Erling Riis and Steven Chu, *Physical Review Letters,* vol. 63, No. 6, pp. 612–615, Aug. 1989.
"Stopping Atoms with Laser Light", John Prodan et al., *Physical Review Letters,* vol. 54, No. 10, pp. 992–995, Mar. 1985.

FREQUENCY STANDARD USING AN ATOMIC STREAM OF OPTICALLY COOLED ATOMS

CROSS-REFERENCE TO RELATED APPLICATION

This is a continuation of co-pending application Ser. No 08/217,893 filed on Mar. 25, 1994, which is a continuation of application Ser. No. 07/983,093 filed on Nov. 24, 1992, now U.S. Pat. No. 5,338,930, which is a continuation-in-part application of U.S. patent application Ser. No. 07/531,754, filed Jun. 1, 1990, titled AN IMPROVED FREQUENCY STANDARD USING AN ATOMIC FOUNTAIN OF OPTICALLY TRAPPED ATOMS, abandoned, and U.S. patent application Ser. No. 07/561,995, filed Aug. 2, 1990 titled AN IMPROVED FREQUENCY STANDARD USING AN ATOMIC FOUNTAIN OF OPTICALLY TRAPPED ATOMS, abandoned.

BACKGROUND OF THE INVENTION

The present invention relates to an atomic clock that can be used as a high precision frequency standard. Ramsey's method of separated oscillatory fields has been utilized to make an atomic clock. This method aligns the quantum mechanical spin of a number of atoms, allows the atoms to precess, measures the precession and then uses this measurement to calibrate an external oscillator.

In order to measure the behavior of a (relatively) small number of atoms, it is necessary to use a high vacuum environment, i.e. a volume having very little matter in it except for the few atoms being measured. Various techniques for obtaining such an appropriate vacuum are well known in the art and therefore will not be described further.

It is extremely helpful to have the longest amount of time possible to measure the energy levels (frequency) of atoms. One way to obtain a long measurement time is to keep the atoms in one place while measuring them. This can be done by putting the atoms in a cell or bottle; however, the internal kinetic motion (temperature) of the atoms causes them to collide with the walls of the bottle. Those collisions introduce frequency shifts in the energy level measurement.

Another way to measure the energy level of the atoms is to launch them in a "free-fall" trajectory such as an atomic beam. The relatively high speed of atoms in an atomic beam, typically $V>10^4$ cm/s at or above room temperature, limits the time available to make measurements to less than 0.002 sec. Nevertheless, the current generation of frequency standards use atomic clocks which are designed around the use of such an atomic beam.

Atomic clocks could be made more precise if the atoms moved more slowly when their atomic state is being measured. Since the temperature is proportional to the average of the square of the velocity ($<V^2>$), colder atoms mean slower moving atoms. Thus, the problem of making atoms move more slowly is a problem of reducing their temperature.

Cooling atoms in an atomic clock has been a problem for a long time. For example, in the 1950's, a researcher named Zacharias attempted to create a longer measurement time using an atomic fountain. Zacharias' idea was to direct a beam of "thermal" atoms in an upward direction within a chamber and then allow for the force of gravity to reduce their velocity. In principle, an atom can be made to move upward, stop and fall back (the principle is analogous to what happens to a football after kickoff). The period of time that an atom would spend at the top of its arc before returning to its starting position would provide for a longer measurement time. For an atom to follow such a ballistic trajectory, however, requires a low starting velocity, otherwise the atoms will cover far too much distance before gravity can bring them to a stop. More importantly, the atoms had to be cold, i.e., lack significant internal motions to keep upwardly directed beam of atoms from spreading out too far. Thus, while in principle Zacharias' "atomic fountain" could use Ramsey's method in making a high precision frequency standard (atomic clock) from a beam of atoms, it required a source of slow, cold atoms.

Zacharias' experiment stimulated several important developments in atomic physics—developments that ultimately led to the hydrogen maser and precise resonance experiments with bottled neutrons. The experiment with the atomic fountain itself, however, was a failure. Zacharias had hoped to avoid having to use a stream of thermal atoms in which the velocity of the atoms varies along what is known as a Boltzman distribution. A very small fraction of the atoms of a thermal beam move quite slowly. Zacharias hoped to select only these slow atoms for use in making his measurement; however, the faster atoms in the atomic fountain were found to scatter the slower atoms out of the beam and thereby make it impossible to obtain accurate measurements.

Thirty years later, in the 1980's, a technique for slowing atomic motion known as laser cooling was developed. Intense laser light normally causes matter to heat up and thus increase the random motion of the atoms. Under special conditions, however, it is possible to use pairs of laser beams properly positioned and operated to reduce atomic motion. This process is referred to as laser cooling.

One form of laser cooling uses a spherical quadrapole magnetic field and six laser beams aligned in pairs along each of three orthogonal axes to form an "optical trap." The effect that the light from these lasers has on atoms is a phenomena unique to atomic physics which has no analogy in daily experience. The light from each of the laser beams pushes the atoms harder when they are moving toward the laser than when they are moving away from the laser. The six lasers combine to prevent an atom from going anywhere and, indeed, from moving much at all, thus reducing its temperature and, in essence, creating a cooling process.

The six beams are circularly polarized such that, when they interact with the atoms in a magnetic field, they also force the atoms to collect in a small region of space in the center of the magnetic field coils. That process is described in an article by E. L. Raab, M. Prentiss, et al. in 59 Phys. Rev. Lett. 2631 (1987).

Attempts have been made to use very cold neutral atoms in experiments designed to make precise measurements of the microwave frequency "clock" transition of cesium and sodium atoms since, in principle, such an apparatus could be used to create a high resolution clock having small systematic errors. The results of those attempts, however, have been far from ideal. In order to carry out those experiments it has been necessary to use a large vacuum chamber, which is impractical. In addition, the signal to noise ratios generated during the experiments have so far been low, thus further reducing the utility of the concept. Consequently, the art has not yet produced a practical frequency standard using this type of laser cooling process for cooling the atoms.

A further problem arises in confining atoms using a magnetic field. Magnetically confined atoms have been considered unsuitable for use with the frequency standard of an atomic clock because variations in magnetic field strength produce variations in the transition frequency that "smear" the resulting spectrum. These variations can cause both irregularities in the frequency of the atomic clock, as well as render the magnetically confined atoms useless in an atomic clock. The strength of the magnetic field and the amount of resulting smearing also depend on the temperature of the atoms that are being confined. The internal kinetic motion of the atoms in a conventional atomic clock has required far too strong a magnetic field to attain confinement, and no attempt at reducing the kinetic motion through reduced temperature has been known to produce a useful transition.

SUMMARY AND OBJECTS OF THE INVENTION

In view of the foregoing, it should be apparent that there still exists a need in the art for a method of and apparatus for producing a high performance frequency standard which is more accurate and less costly than those frequency standards which are currently available.

It is another object of the present invention to utilize optical cooling to minimize atomic transitions in a magnetic field.

It is yet another object of the present invention to create an atomic clock using an atomic fountain.

These and other objects of the present invention are obtained using a sealed gas vapor cell that is integrated with a single microwave resonance cavity. Individual atoms are launched into the resonance cavity from an optical trap using a shift in the frequency of the incoming laser light so as not to heat the atoms in the process. The laser light preferably comes from laser diodes and the frequency shift of the light can be generated by moving two mirrors.

The present invention uses a laser cooling process to slow the atoms before launching them in a ballistic trajectory. This laser cooling process reduces the internal kinetic motion of the atoms before gravity slows the ballistic motion of the atoms.

The laser cooled atoms can be made to move slow enough to serve as a source for an atomic fountain. Further, through the operation of the present invention, atoms, for example cesium atoms, can be stored in a vacuum chamber and optically trapped as needed by actuating the laser trap without need the of "pre-cooling" the atoms. The atoms can then be launched on a ballistic trajectory by changing the frequency of the laser light along the axis of desired motion.

The vacuum chamber in accordance with the present invention can include a sealed-off glass bulb which encloses a microwave resonance cavity. Pairs of laser diodes are appropriately positioned around the chamber. These laser diodes are used to supply the laser light at the resonance frequency of the atoms, i.e. the frequency at which the atoms absorb the laser light.

The present invention uses beams of laser light to trap and cool cesium atoms in a small vapor cell and to put the atoms in a particular quantum mechanical state. The lasers are configured so as to launch the atoms in an upward direction, and then to optically pump them into the clock transition state before turning the light off. The atoms rise to a height of, for example, about 4 cm before falling back due to gravitational forces. That height is arbitrary and only a matter of optimization of the particular operation.

The atoms pass through a microwave waveguide during both their ascent and descent. The microwave field is applied briefly each time the atoms are in the center of the waveguide so that the microwaves excite the cesium "clock" transition.

Once the atoms have fallen back to where they started, the laser fields are used to measure the fraction of the atoms that make a quantum mechanical transition. This signal indicates how close the microwave frequency is to the atomic transition. As in existing atomic clocks, that information is used to adjust the microwave frequency so that it remains the same as the atomic transition frequency. The laser cooling and trapping operation of the present invention, however, causes the atoms to move much more slowly than in conventional atomic clocks. For that reason, the stream of atoms stays together for a longer time period and, therefore, can be observed over a longer time period for significantly improved measurements. The resulting width of the atomic resonance is much narrower.

Furthermore, the slower velocity of the atoms means that the present invention can use a smaller cell than those used in present atomic clocks. That compact size makes the present invention far more practical, transportable and easier to shield from external disturbances such as magnetic fields that would cause the frequency of the atoms to shift. Most importantly, the use of lower velocities reduces important systematic errors that increase as the velocity of the atoms increase.

Yet another embodiment of the present invention combines the optically cooled atoms with a magnetic confinement track. Whereas variations in the (relatively) strong magnetic field needed to confine atoms produce variations in the transition frequency that cause irregularities in the frequency of the atomic clock, optically cooled atoms require substantially less of a magnetic field to attain confinement. Moreover, the transition energies for properly selected transition states, such as the 6S F=3, m=1 to 6S F=4, m=−1 transition in Cesium, shift in substantially the same direction and by substantially the same amount in response to the application of a magnetic field.

Hence, it has been discovered that the combination of a (relatively) weak magnetic field to confine the optically cooled cesium atoms and a (relatively) insensitive transition combine to enable optically cooled atoms to be magnetically confined in two dimensions without disruption of the transition frequency. These atoms remain free to move in a third dimension. This allows the vertical "atomic fountain" to be turned into a nearly horizontal "atomic incline." Because the atoms are sliding up and down a gradual incline in this embodiment, the time they spend between transits through the microwave cavity can be many seconds instead of the tenths of a second possible with the "fountain" geometry, and the thousandths of a second achieved with current atomic beam clocks. This longer time between the applications of the microwave field produces a corresponding decrease in the width of the atomic transition of interest and thus a more precise clock.

Confining the atoms on a track also has a further advantage. The track can be used to guide the atoms around corners to optical stations where they can be optically probed. Such optical stations may be out of sight of the optical trapping region or the microwave transition region. This eliminates the necessity of turning off the optical trapping and cooling lasers during the measurement process, and hence allows continuous or quasicontinuous measurements of the frequency.

DETAILED DESCRIPTION OF THE PREFERRED EMBODIMENT

Figure 1:
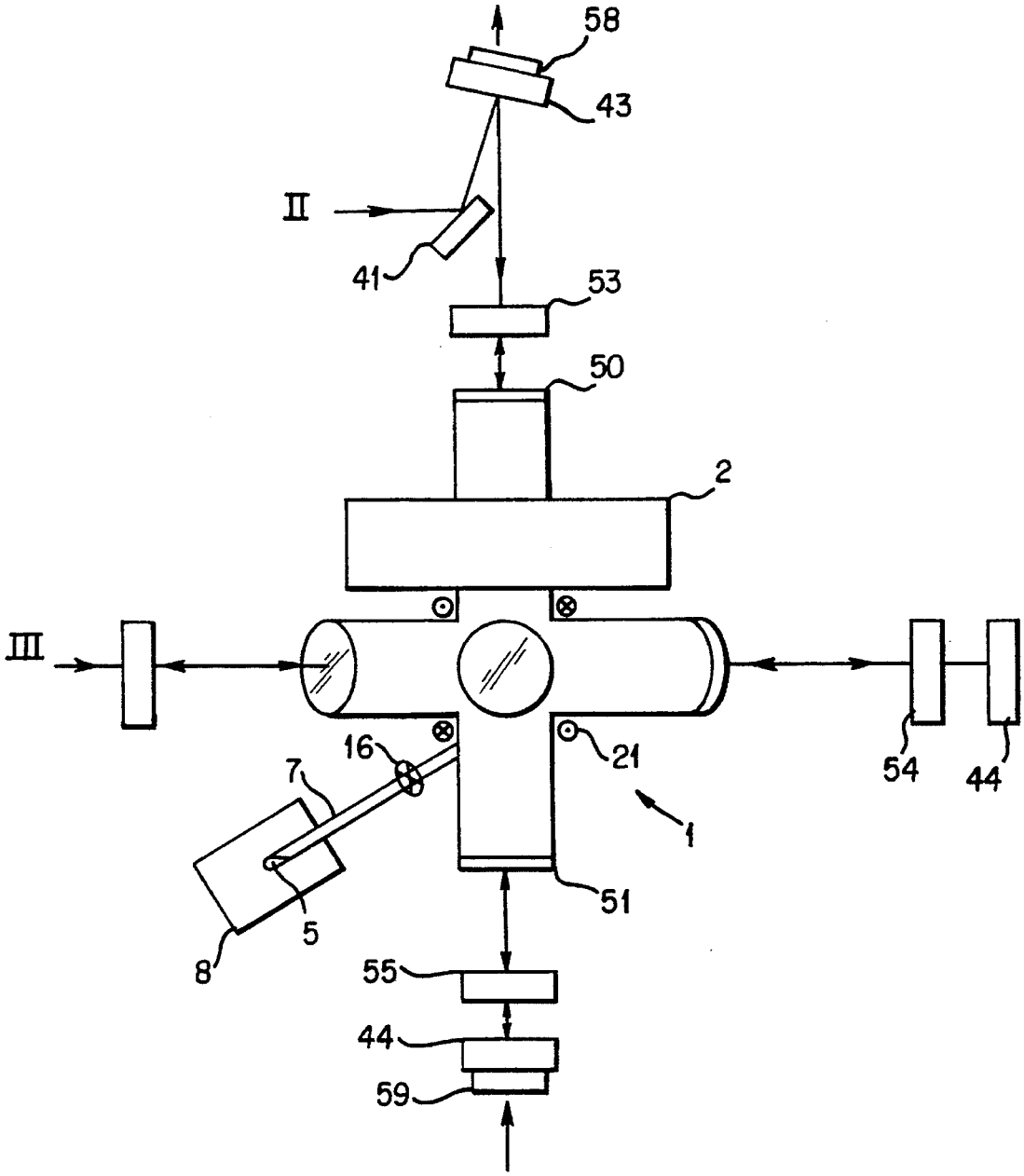
FIG. 1 is a cross section of a frequency standard according to the present invention.

Referring now in detail to the drawings wherein like parts are designated by like reference numerals throughout, there is illustrated in FIG. 1 the frequency standard system of the present invention. The frequency standard system includes a vacuum chamber 1, which is preferably made from glass or metal and has a low permeability to helium. The vacuum chamber 1 encloses a microwave resonance cavity 2. A pump, such as a Vacion pump, not shown, may be used to maintain a high vacuum in the vacuum chamber 1.

A small glass finger 7 is connected to the vacuum chamber 1 by means a valve 16. The small glass finger 7 is utilized to contain a small amount of a particular species of atoms, such as, for example, 0.5 grams of metallic cesium 5. A thermoelectric cooler 8 is utilized to cool the bottom of the glass finger 7 to about −20 Centigrade. An electronic sensor, not shown, closes the valve 16 in the event that the temperature in the cold finger 7 exceeds a predetermined level, such as −10 Centigrade.

Alternatively, the cesium vapor pressure can be controlled by incorporating the cesium in some compound or by binding it to a surface so that the vapor pressure is about 0.5 nanotorr at the operating temperature of the vacuum chamber 1. It is also possible to add cesium directly to the vacuum chamber 1 and to produce a cesium pressure of 0.5 nanotorr so that the cesium remains at that value after the cell has been sealed off.

Two lasers 3, 4, which may preferably be laser diodes, are utilized to launch light into the vacuum chamber 1. The light from the two lasers 3 and 4 passes through two lenses 43, 44, respectively, or comparable devices such as mirror optics, which focus the light from the lasers 3, 4 at the center of optical trap 12 which is contained within the vacuum chamber 1. The optical trap 12 is shown in cross-section in FIG. 2. Mirrors 43 and 44, which are aligned with two of the entrances to the optical trap 12, reflect the laser light exiting from two of the windows of the optical trap 12 back into the optical trap 12.

Figure 2:
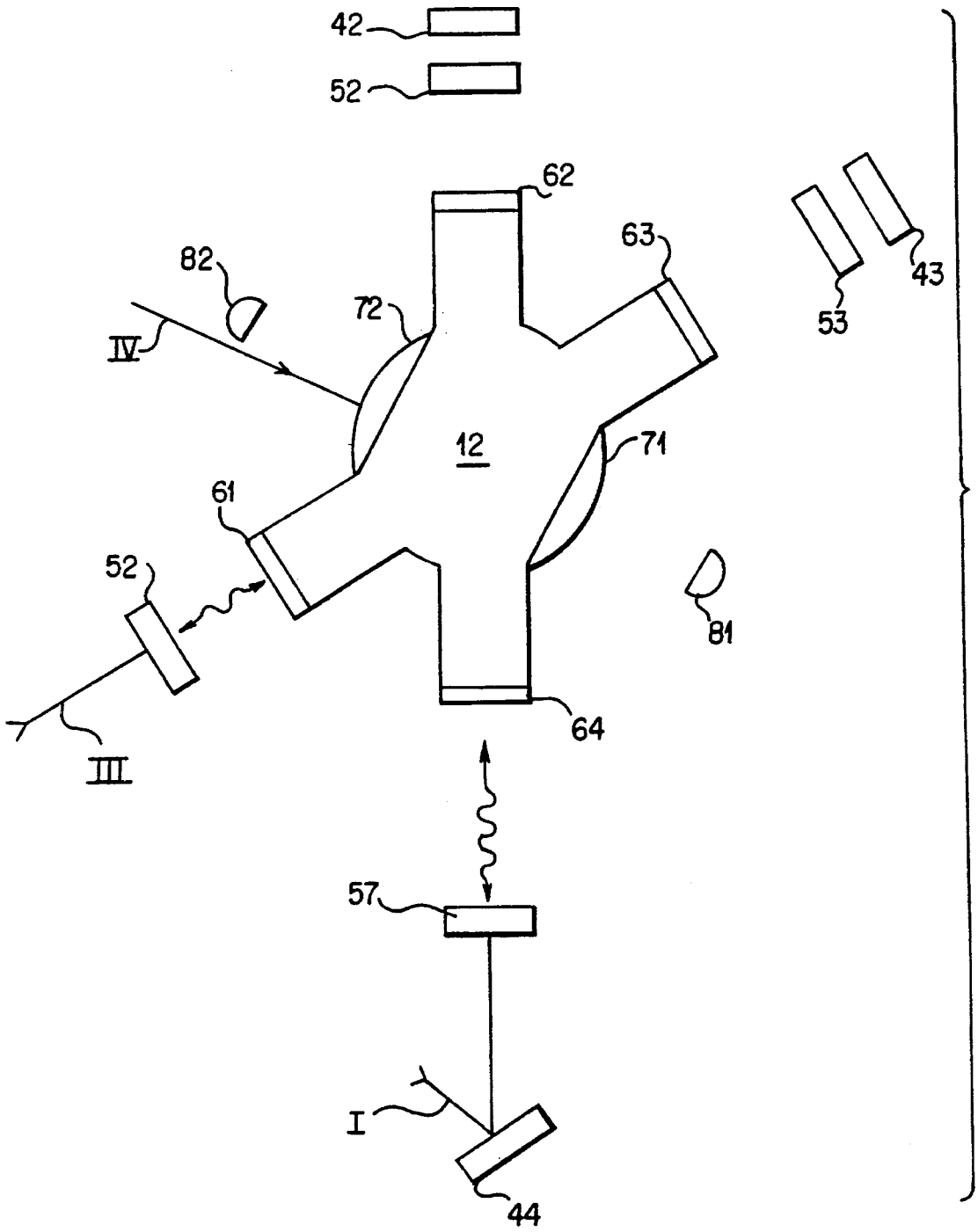
FIG. 2 is a cross section of the optical trap of the frequency standard shown in FIG. 1.

A plurality of quarter wave plates 52–57 are utilized as shown in FIGS. 1 and 2 to create the circularly polarized light needed to trap the atoms according to the magnetic-optic trap scheme described by E. Raab, et al., 59 Phys. Rev. Lett. 2631 (1987). The quarter wave plates 52–57 are oriented to produce an optical trapping force in a known manner as discussed by in the above reference.

As shown in FIG. 1, the mirrors 43, 44 located above and below windows 63, 64 are mounted on a tracks 58, 59 such that they can move vertically as will be discussed later herein. A pair of lenses 71, 72 are attached directly to the walls of the vacuum chamber 1 and surround the optical trap 12 as shown. Those lenses 71, 72 focus light emitted by the atoms in the optical trap 12 onto silicon photobodies 81 and 82. The current from those photobodies is supplied to electronic circuitry, not shown, for analysis according to known procedures.

The entire vacuum chamber 1 is surrounded by magnetic field coils, not shown, which produces a uniform 30 mG magnetic field in the vertical direction. That solenoid is surrounded by sheets of magnetic shielding material, also not shown, which prevent any magnetic fields in the environment from penetrating the vacuum chamber 1.

The apparatus shown in FIG. 1 is constructed in the following manner. First, the vacuum chamber 1 is thoroughly cleaned and then evacuated using standard high vacuum practices so that a pressure of 0.5 nanotorr or lower is achieved. The cesium is then distilled into the chamber 1 from the glass finger 7, or as alternatively described above, and the chamber is sealed off. Alternatively, an ion pump can be attached to the vacuum chamber 1 in order to maintain the desired low vacuum. Such a pump can be operated either continuously or intermittently, as known in the art.

Referring now to FIG. 2, there is shown a cross-sectional view of the optical trap 12 of FIG. 1. Four windows, 61–64, made of glass, sapphire or other material which preferably has a low permeability to helium, are sealed to the vacuum chamber 1. A beam splitter 41 divides light from the laser 4 so that transfer optics, such as the mirror 44, direct the laser light through a quarter wave plate 54 through window 64 into the optical trap 12.

FIG. 1 shows how the present invention requires only a single microwave cavity 2. The microwave cavity 2 is positioned above the optical trap 12 and integrated with the vacuum chamber 1. The microwave cavity 2 induces atomic transitions between the atomic states of the cesium atoms as known in the art. The preferred embodiment of the microwave cavity 2 is shown in a top cross-section view in FIG. 3.

Figure 3:
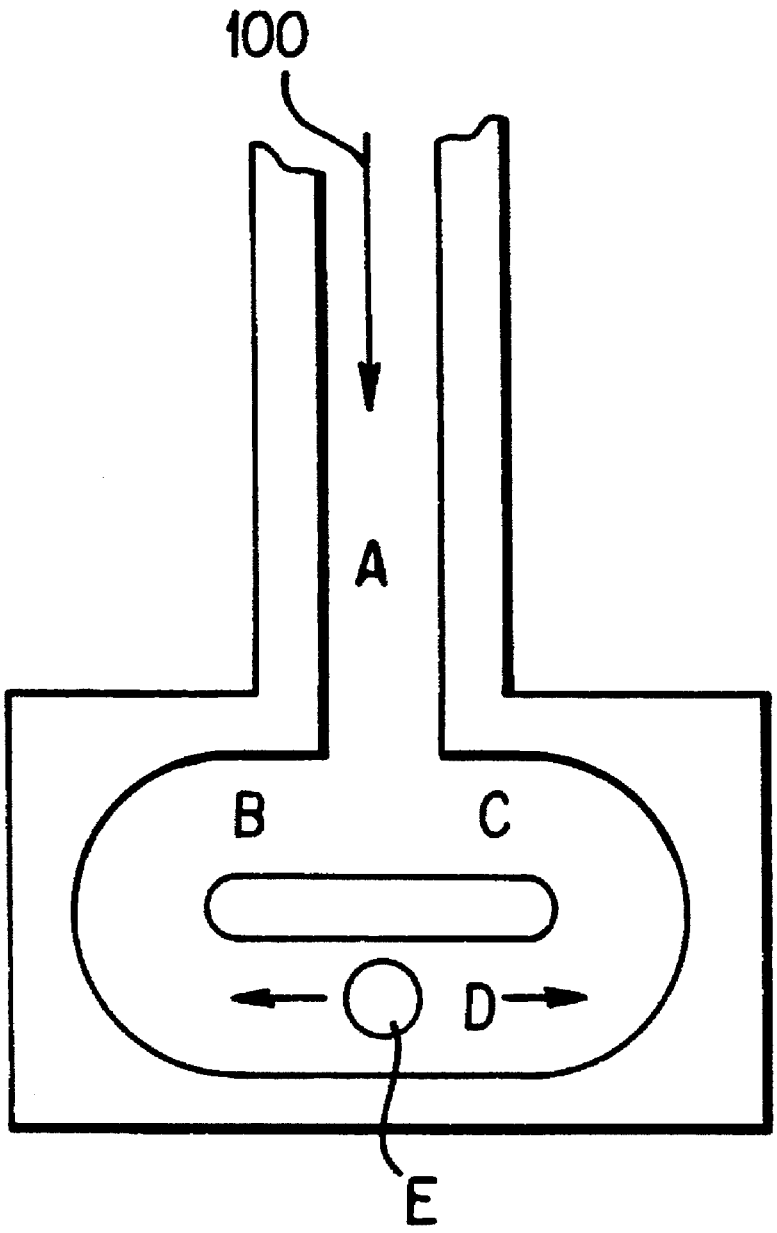
FIG. 3 shows the microwave waveguide for the frequency standard shown in FIG. 1.

As shown in FIG. 3, the microwave radiation 100 enters the microwave cavity 2 from the region A and is equally divided into two travelling waves, B and C. The microwaves form a standing wave in region D. It is that standing wave that excites the atoms that are ejected from the optical trap 12 into the microwave cavity 2. The magnetic field thus generated in the microwave cavity 2 is linearly polarized in region D and points along the direction of a chosen "quantization axis" which may be chosen to point out of the page of FIG. 3 along the z-axis or along the x-axis. Once ejected, the atoms from the optical trap 12 pass through the hole E in the microwave cavity 2 and are then excited with respect to the quantization axis. The hole E may preferably have a diameter of, for example, 5 millimeters. The microwave cavity 2 may preferably be made of copper.

In addition to being excited with respect to the quantization axis, the cesium atoms in the optical trap 12 must also be optically pumped with respect to that quantization axis. Additionally, a weak bias magnetic field must also be imposed on the optical trap, directed along the quantization axis. It has been shown by A. De Marchi et al., in IEEE Trans. Inst. and Meas. 37, 185 (1988) that such a microwave cavity 2 is particularly suitable for reducing the cavity phase shifts which are the most troublesome systematic frequency shifts plaguing the current generation of atomic clocks. The cross-section of the microwave cavity 2 is designed such that the magnetic field produced therein is linearly polarized and is directed along the quantization axis.

The microwave cavity 2 is joined to the optical trap 12 using glass to metal seals and forms part of the overall vacuum chamber 1. The microwaves 100 are brought into the vacuum chamber using standard practice and procedure. The power level of the microwaves 100 is set such that the power in both of the microwaves B and C is matched and that a 5 ms pulse corresponds to a ⅔ excitation of the clock transition.

Figure 4:
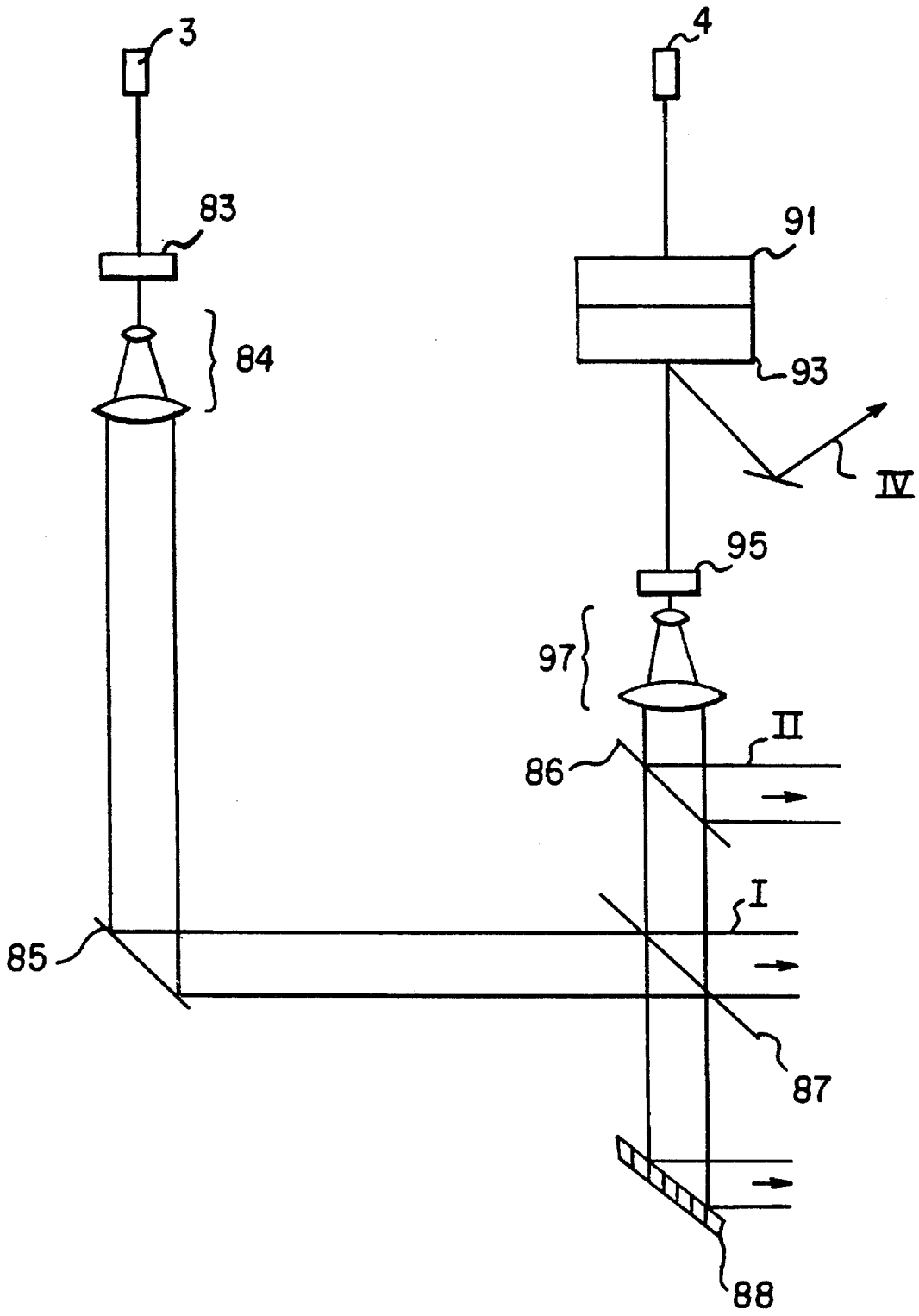
FIG. 4 shows the optical configuration used to provide the laser beams needed for the optical trap of FIGS. 1 and 2.

FIG. 4 shows one mode of operation of configuring the lasers as shown in FIGS. 1–3. Lasers 3, 4 produce the laser light. The frequency of the laser light may be controlled using a variety of different laser frequency control schemes. Although a shutter 83 is shown for controlling the light from the laser 3, its function can be performed by directly changing its injection current.

One facet of each of the lasers 3, 4 may be anti-reflection coated such that the light emerging from that facet is reflected back off of a diffraction grating. The frequency of the light may then be controlled by adjusting the position of the grating and the current through the laser. The diffraction grating and/or current to the laser can thus be set to the desired frequencies by observing the absorption of the light in a small cell containing cesium vapor.

The frequency of one laser can be set to within 20 MHz of the 6S (F=3) to 6P (3/2), F'=4 transition of cesium. The exact frequency of the laser 3 is unimportant as long as it is in the vicinity of the 3 to 4' or 3 to 3' transitions. The frequencies for the laser 4 can differ by a few MHz without affecting the clock. Henceforth, only the F' value for the 6P (3/2), F' state will be specified.

As shown in FIG. 4, the beam from the laser 3 is sent past the shutter 83 and then expanded by a beam expander 84, in order to produce a collimated beam of, for example, 0.75 cm in diameter. The vertical beam is apertured to 0.45 cm. in diameter to pass through hole E in the microwave cavity 2. The laser beam 3 may preferably have a power of between 1 and 10 mW, the precise value being approximate. The laser beam 3 is reflected off of the mirror 85 and is combined with the light produced by the second laser 4, using a beam splitter 87, before going to the optical trap 12. The frequency of the laser 4 is set to be slightly below the 6S, F=4 to F'=5 transition of cesium and changes slowing during the data acquisition cycle, as discussed below.

The light beam produced by the second laser 4 is passed through an optical isolator 91 to an acousto-optic modulator 93. Alternatively, it may be possible to align the two laser beams 3 and 4 in such a way that the isolator 91 is not necessary. Alternatively, another laser could be utilized to obtain the F=4 to F'=4 excitation light, beam IV in FIG. 4, or, during the brief time that this light is needed, the frequency of the laser 3 could be shifted by adjusting its current or the position of the reflection grating 85.

In another alternative, the pumping step described herein may be omitted and the signal produced for use by the optical trap would be reduced a factor of 7. Another alternative is to utilize a simpler pumping scheme using the F=4 to F=5' light, which is already present. That scheme would reduce the signal provided to the optical trap 12 by a factor of 3.

The modulator 93 briefly produces a frequency shifted beam of light, beam IV in FIG. 4, which excites the 6S F=4 to F'=4 transition of cesium and is directed into the optical trap 12 through lens 72. As will be described later herein, most of the time, the modulator 93 is turned off and does nothing.

After the modulator 93, the beam from the laser 4 passes a shutter 95 and transverses a beam expander 97. After passing through the beam expander 97, the beam is, for example, a collimated beam of 0.75 cm in diameter. That light is split into three beams, I, II and III, as shown in FIG. 4. Beam splitter 86 reflects the second beam II which contains about 30% of the power from the laser 4 to the window 50 as shown in FIG. 1. Mirror 88 reflects the third beam III which also has about 30% of the power of the laser beam 4 to the window 61 of FIG. 2. Beam splitter 87 combines light from each of the lasers 3 and 4 to form beam I which is transmitted into the optical trap 12 as shown in FIG. 2. Light from the three beams reflects from mirrors 42 and 43 of FIG. 2 and 44 of FIG. 1 back into the optical trap 12.

In order to launch the atoms into a fountain, it is necessary to utilize at least one of the laser beams entering the optical trap 12. Using a simple approach, the atoms can be launched by illuminating them with a single vertical laser beam which is going upward. Although that approach is simple, it also heats the atoms which cause them to spread out faster. Another way in which to launch the atoms in a fountain is to shift the frequency of the laser light for the vertical pair of laser beams.

The preferred method of launching the cesium atoms without heating them is to shift the downward travelling laser beam by −0.4 megahertz and the upward going laser beam by +0.4 megahertz, relative to the laser beams propagating in the horizontal plane. Such frequency shifts require that the bottom mirror 44 be moved twice as fast as the top mirror 43 in the directions indicated by the arrows shown in FIG. 1. Alternatively, acousto-optic or electro-optic devices can be utilized to accomplish the frequency shifts.

The standard frequency generated by the present invention is obtained using the following procedure. First, both of the lasers 3 and 4 are turned on and the 4 to 5' frequency and set 7 megahertz below the center of the 4 to 5' transition. Current is sent through the antiHelmholtz coils 21 which surround the optical trap 12, as shown in FIG. 1. The system remains in this state for a short period of time, for example, 0.1 seconds, during which time the atoms, here cesium atoms, are captured out of the vapor from the cold finger 7 and held in the optical trap 12 without precooling. The laser light received in the optical trap 12 cools the trapped cesium atoms to about 250 microkelvin.

The current to the antiHelmholtz coils 21 is then turned off and the frequency of the lasers 3, 4 is changed to 30 megahertz below the 4 to 5' resonance. The cesium atoms are then cooled to less than 10 microkelvin using laser cooling. After 2 ms, the track 58 moves the mirror 43 upward at a velocity of 0.45 meters per second and the mirror 44 is moved upward at a velocity of 0.9 meters per second by a second track 59. The mirror 41 tilts to keep the base light centered on window 50.

The movement of the two mirrors 43, 44 causes the small cloud of cesium atoms in the center of the optical trap 12 to move upward with a velocity of 0.9 meters per second. That movement continues for 2 ms, at which time the shutter 95 closes and the acousto-optic modulator 91 is turned on.

The cesium atoms are illuminated by beam IV for 0.1 ms by a 0.3 mW per $cm^2$ beam of light from the laser 4 which is tuned to the 4 to 4' resonance. Beam IV is the two frequencies of laser light from the laser beams 3 and 4, as previously described, combine to put all of the atoms into the 6S F=4 m=0 state.

The lasers 3 and 4 are then switched off and the cesium atoms fly freely upward. During the time that the lasers 3 and 4 are switched off, the mirrors 43, 44 returned to their starting positions. When the atoms reach the center of the microwave waveguide 2 about 0.022 seconds later, the microwaves 100 in FIG. 3 in the microwave cavity 2 enter for 5 ms. The frequency of the microwaves 100 is set such that it is half way down the high frequency of the 6S F=4, m=0 to 6S F=3 m=0 (the "clock" transition) of the central Ramsey resonance fringe. The cesium atoms then continue to rise into the microwave cavity 2 until they are about 4 cm above their starting point, at which point they come to a stop because of the force of gravity.

The atoms fall back through the microwave waveguide 2 and, when they are again in the middle of the microwave cavity 2, an identical 5 ms microwave pulse is applied. The atoms fall through the hole E in the microwave cavity 2 and return to the region of the optical trap 12 after about 0.18 seconds from the time they started upward. At that time, the main beam from the laser 4 is turned back on by opening its shutter 95 while at the same time the frequency of the laser 4 is reset to 7 megahertz below the 4 to 5' resonance. At that point, the two detectors 81 and 82 collect the fluorescence light from the cesium. The current from the two detectors during the first 5 ms after the light from the laser beam 4 is turned on is integrated and the value stored. After the expiration of 5 ms, the laser 3 is again turned on and the detector currents from the detectors 81 and 82 are again integrated for 5 ms and stored. By dividing the first value obtained from the detectors by the second value, the probability that an atom underwent a transition during its flight is obtained, in accordance with known methods.

Other known methods of normalization can also be used, such as measuring the fluorescence signal before the atoms were launched, or extracting the transition probability from only the first fluorescence signal without normalization if the number of atoms is sufficiently constant enough. The resulting value is compared with half the original value. The difference indicates how far the microwave source has drifted with respect to the atomic frequency. The frequency of the microwave source is then corrected by the appropriate amount.

After the second 5 ms fluorescence measurement, the current through the antiHelmholtz coils 21 is turned back on and the cycle is repeated. For every other cycle, the microwave frequency which is applied to the cesium atoms is changed from being half way down the high frequency side of the resonance to half way down the low frequency side. Everything else remains the same.

The principles, preferred embodiments and modes of operation of the present invention set forth above should not be interpreted as limiting the present invention. Numerous alternative embodiments are possible. For example, laser beams could be confined in optical fibers, with all the switches, beam splitters, etc. being optical fiber compatible elements so long as the total force exerted on the atoms from all the beams add up to zero in the center of the trap. Four tetragonal beams, for example, would also work.

It is also possible to form the optical trap 12 with different geometries. The "atomic fountain" could be replaced by having the atoms simply fall, in which case two microwave structures would be needed for the atoms to fall through with separate laser beams for the fluorescence detection at the bottom. It is also possible to launch the atoms on a arching parabolic path which would pass through the two microwave fields. While again needing a separate detection region, a parabolic arch has the advantage of allowing the atoms to be shielded from the light emitted from the initial trapping and final detection regions while they were in and between the microwave fields. The trapping region could thus be an "atomic funnel" of the sort demonstrated in a recent article in the Physics Review Letters by E. Riis, et al. 64 Phys. Rev. Lett. 1658 (1990) in which atoms go up continuously rather than in pulses. The resulting clock transition signal would also be a continuous rather than a pulsed signal. It is also possible to operate the atomic clock with atoms of rubidium rather than cesium since only the wavelengths of the laser light and the microwave frequency would change.

Figure 5:
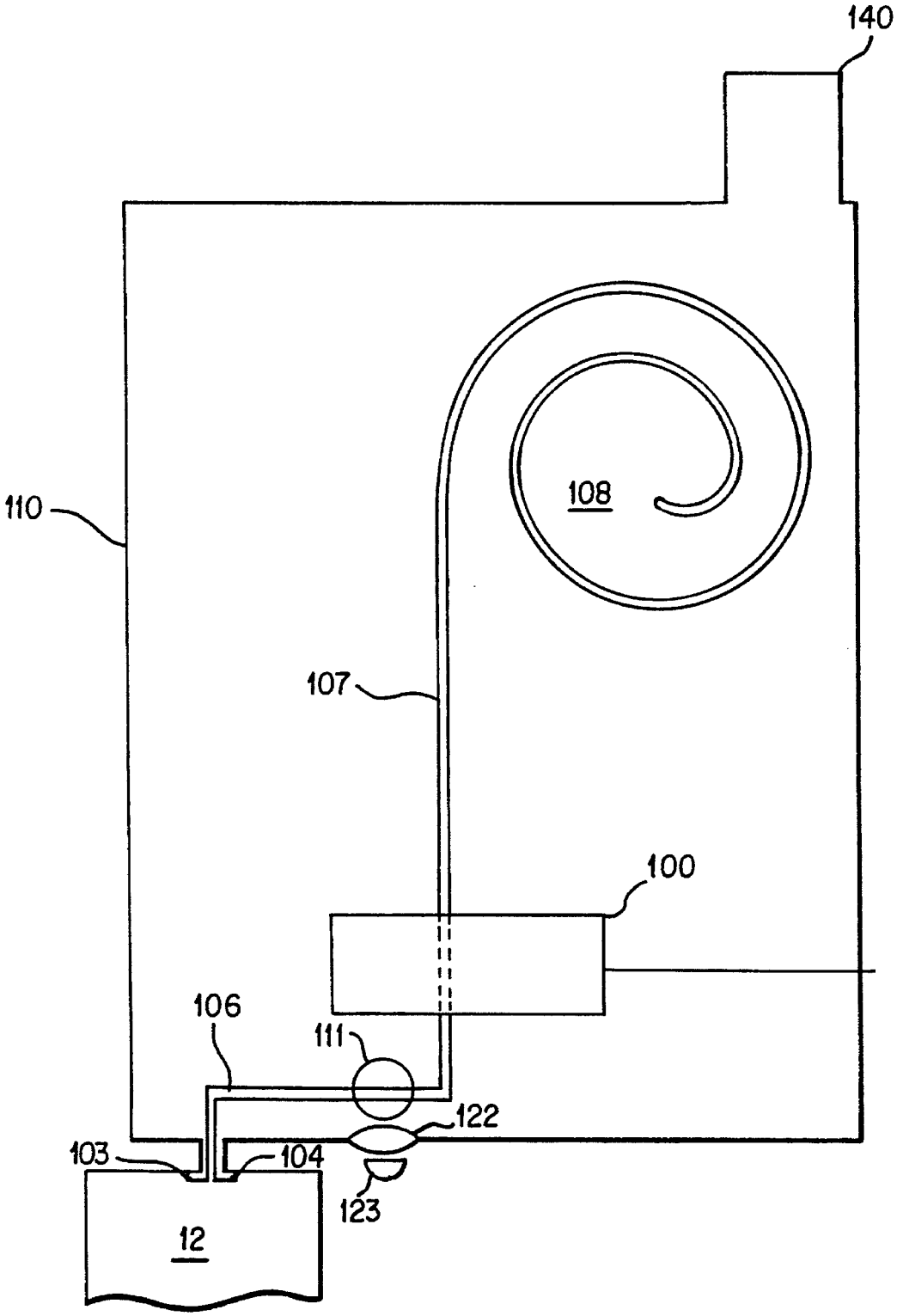
FIGS. 5 and 6 show an alternate embodiment of the present invention using optically cooled atoms trapped in a magnetic field.
Figure 6:
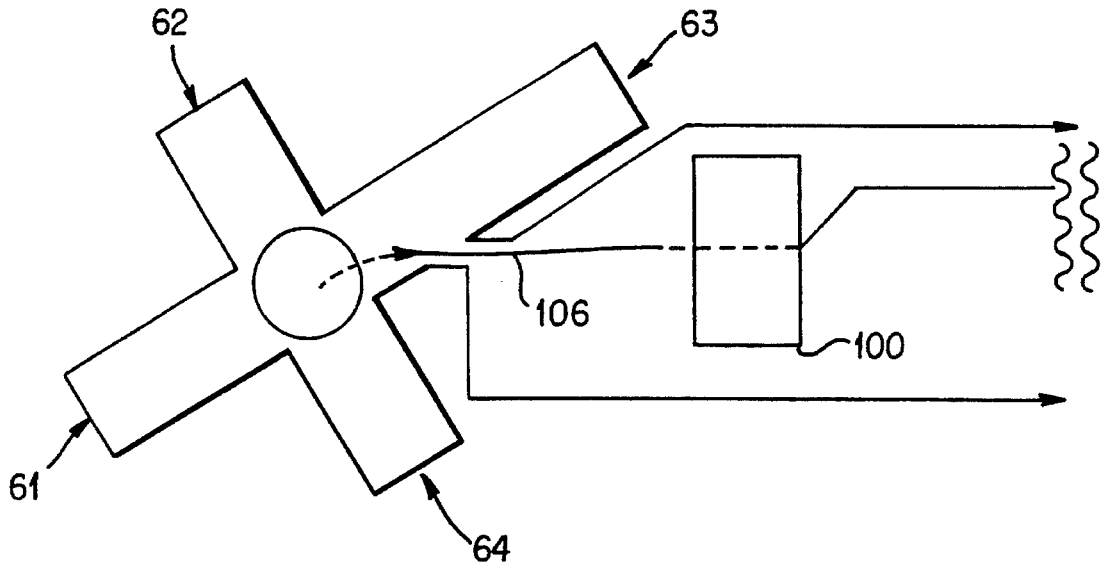

Yet another embodiment of the present invention shown in FIG. 5. This embodiment uses a magnetic confinement guide 106 to guide the atoms from the optical trap 12 into a second vacuum chamber 110. In this embodiment the optical trapping region is similar to that shown in FIGS. 1 and 2 except that it is rotated so that the laser beams which were vertical in those figures, now are at an angle of 30 degrees with respect to the horizontal, as shown in FIG. 6.

The atoms are launched and cooled as discussed above in connection with the the previous embodiment, except that instead of shifting the frequencies of the beams by + and −0.4 megahertz they should only be shifted by + and −0.3 megahertz. This alternative frequency shift will result in the atoms landing on the magnetic confinement track 106, which is positioned at a distance, for example, of 1.5 cm from the center of the optical trap. In this example, the atoms will arrive at the track 106 with no vertical velocity and a horizontal velocity of about 50 cm/sec.

In this example, the atoms could be launched approximately every 0.1 seconds, and the trapping laser beams could be turned back on immediately after launching and cooling. The launched atoms need not be subjected to any optical pumping, in which case only the fraction of the atoms (about ⅓) which are in the 6S F=4, m=1 state will be used in the subsequent frequency measurement.

Other embodiments are of course possible. For example, one alternative to this embodiment would be to use circularly polarized light which excites the F=4 to F'=4 transition to pump the atoms into the 6S F=4, m=4 state immediately after launching. As soon as the atoms enter chamber 110 they would be converted into the F=4, m=1 state using magnetic and radiofrequency fields through the process known as "adiabatic fast passage".

As illustrated in the top view shown in FIG. 5, the atoms would continue along the magnetic guide 106 which must be carefully adjusted so that it is horizontal. The atoms would first pass through an observation region 111 discussed below, and then through microwave cavity 100. This cavity is similar to that discussed in the previous embodiment except that it operates at a frequency 4.6 GHz which is exactly half the standard cesium "clock" frequency. The atoms must pass through the microwave cavity 100 so that the guiding track is perpendicular to the oscillating magnetic field in the cavity. The 4.6 GHz microwaves excite the F=4, m=1 to F=3, m=−1 two photon transition. The microwave power is coupled into the cavity as before and the power level is set so that in the time the atoms pass through the cavity they experience a $\lambda/2$ pulse for the two photon transition.

After leaving microwave cavity 100, the atoms follow the guide 106 up a rise 107 of, for example, 1.2 cm. The rise 107 slows the atoms to about 10 cm/sec. The atoms continue along the horizontal track 106 for about 50 cm until they reach the end at 108. The track 106 can follow any shape in the region between 107 and 108 as long as the track remains horizontal. At end 108, the track 106 goes up at, for example, a 1 cm rise. The atoms, however, will go up only a small fraction of this height before reversing their path and coasting back down the track in the opposite direction. This motion leads them back through the microwave cavity and then through the observation region 111.

The observation region 111 is illuminated by a laser beam which comes through a window 122 in the top of the vacuum chamber 110. The laser beam can be obtained by splitting off a small part of laser 3 and sending it through an acoustooptic modulator 122 which shifts the frequency of the laser light so that it excites the 6S F=3 to 6P F=2 transition. In the example shown, the laser beam is 3 mm in diameter and contains 0.1 microwatts of power. This laser beam excites the atoms which have made the two photon clock transition. The atoms which are excited will reemit photons which are focused by lens 122 onto detector 123. This signal from detector 123 can be used to determine the microwave frequency as in the previous embodiment.

In the embodiment shown, the atoms are loaded onto the magnetic guide every 0.1 second, but in the 10 or more seconds they take to go up and back on the guide the individual bunches will spread out by more than their original separation. The signal at observation region 111 is thus made continuous.

The vacuum chamber 110 can be constructed from glass and metal using standard techniques. The vacuum and vacuum chamber 110 can be retained at a pressure of $10^{-10}$ torr or less using pump 140 and known methods as discussed above in connection with the first embodiment. The vacuum chamber 110 is preferably surrounded with well known magnetic shielding material to prevent external magnetic fields from penetrating the chamber. Alternative structures are possible, of course, provided that the high vacuum is maintained.

Figure 7:
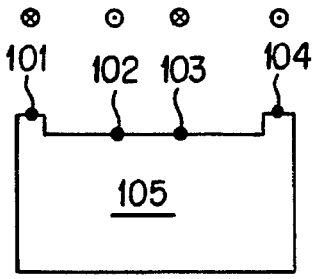
FIG. 7 shows details of the magnetic field used to trap the atoms in FIGS. 5 and 6.

The magnetic guide is shown in detail in FIG. 7. It is made up of 4 wires 101–104. The magnetic confinement is provided by the wires 102 and 103. These wires, in this embodiment, can be spaced apart by about 1 mm and carry currents of 10 amperes each, with the currents flowing in opposite directions as illustrated by the arrow head-and-tail notation. As shown in FIG. 5, this current comes into and leaves the vacuum chamber through standard feedthroughs by way of the wires 102 and 103 which are connected together at connection 108. Wire 101 has a current which is opposite to that of 102, and this same current returns along wire 104 opposite to the flow in wire 103. The current through wire 101 and wire 104 is carefully adjusted to insure that the magnetic fields felt by the trapped atoms is vertical and no larger than 0.2 Gauss. The wires are mounted on a support structure 105 which holds them ridged and conducts away the heat generated by the currents.

Alternative confinement structures could be made using additional sets of wires which would allow more elaborate control of the magnetic fields. For example, with an additional set of four wires placed slightly above the wires 101–104 shown, the atoms could be more rigidly confined against up and down motions. This alternative structure would make the atomic clock less sensitive to vibrations.

An alternative embodiment to the magnetic confinement shown in FIG. 5 would be to have the atoms go through two separate microwave cavities. This could easily be accomplished by having the magnetic guide 106 go through two cavities, with the observation region 111 being after the second cavity.

One thing needed to obtain only a small amount of smearing in the embodiment shown in FIGS. 5–7 is to choose the appropriate transition to measure. For example, in the 6S F=3, M=1 to 6S F=4, M=−1 transition in Cesium, the magnetic field shifts each state by substantially the same amount in substantially the same direction. This particular transition involves a "two photon transition" requiring the absorption of two photons with a frequency of one-half the transition energy. The transition can be accomplished using a 4.6 GHz signal from the cavity 100. This transition in Cesium is particularly useful because, although the energy of both states shifts with the magnetic field, each state has almost the same dependency on the magnetic field. As a result, the transition energy between the two states has very little frequency shift and the confining magnetic field causes little smearing.

The second feature needed to reduce smearing by the confining magnetic field is to keep the magnetic field experienced by the atoms low, e.g., less than 0.1 G. The currents on the wires, 101 and 104 in FIG. 7 can be adjusted so that the point where the downward magnetic field gradient is 96 G/cm, the magnitude of the magnetic field will be less than, for example, 0.2 G. These conditions permit the atomic transition frequency to have a spectrum with a central peak with small side lobes separated by the side to side oscillation frequency of the atoms in the magnetic guide 106. The magnetic field gradient of 96 G/cm also overcomes the force of gravity so that the atoms remain moving along the magnetic guide.

A confinement field of only 0.1 G requires that the atoms be very cold. A temperature of 1 degree microkelvin will permit the atoms to sample a field variation of less than 0.1 G. This temperature, of course, can be obtained using laser cooling in the optical trap 12. With such a low temperature and a proper geometry of wires, the atoms will remain within the magnetic trap formed by the guide 106 for an extended period of time. This will make the resonance line width very narrow. The continuous detection of a signal will also permit improved signal to noise at the detector. The combination of these factors will result in greatly improved clock performance.

The technology discussed in connection with FIGS. 1–4, when used in conjunction with that discussed in FIGS. 5–7, will permit an integration time of more than ten seconds and a line width of 0.05 Hertz. That accuracy represents a substantial improvement over current atomic clocks.

The magnetic guide 106 has advantages in addition to narrow line width. For example, the continuous monitoring of the signal is more advantageous than the atomic fountain disclosed in FIGS. 1–4 since there is less chance of significant errors in the main oscillator going undetected between pulses. Furthermore, the atoms can be confined in a track independent of motion of the clock, thus leading to a device having increased tolerance to mechanical vibration.

In view of the multiple alternative embodiments of the present invention, the forgoing specification should not be interpreted as limiting the scope of the following claims.

Although only a few preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An optical trap for optically trapping and cooling a predetermined species of atoms from an ambient or lower temperature vapor, comprising:

a sealed vacuum chamber for optically trapping and cooling said predetermined species of atoms from said vapor;

means for introducing said predetermined species of atoms into said vacuum chamber;

means for generating a plurality of laser beams; and means for directing each of said plurality of laser beams into said vacuum chamber from a different angle relative to a target area inside said vacuum chamber such that said target area has a net light pressure of zero.

2. The optical trap of claim 1, wherein said directing means comprises means for pointing a plurality of laser beams at said target area.

3. The optical trap of claim 1, wherein said means for generating a plurality of laser beams comprises laser diodes.

4. The optical trap of claim 1, wherein said predetermined species of atoms are atoms of cesium.

5. The optical trap of claim 1, wherein said predetermined species of atoms are atoms of of rubidium.

6. The optical trap of claim 1, wherein said means for directing comprises means for directing said plurality of laser beams into said vacuum chamber along at least three different axes relative to said target area.

7. The optical trap of claim 1, wherein said means for introducing said predetermined species of atoms into said vacuum chamber is maintained at ambient or lower temperature.

8. The optical trap of claim 1, wherein said vapor of said predetermined species of atoms is concentrated at said target area.

9. The optical trap of claim 1, wherein said predetermined species of atoms in said target area are cooled to a temperature of 10 degrees microKelvin or less.

10. The optical trap of claim 1, further including means for changing the frequency of at least one of said plurality of laser beams in at least one direction such that said light pressure in said target area becomes nonuniform in said at least one direction.

11. The optical trap of claim 10, wherein said frequency changing means comprises at least one of two movable mirrors and acousto-optical modulators.

12. A method of forming an optical trap for optically trapping and cooling a predetermined species of atoms from an ambient or lower temperature vapor, comprising the steps of:

forming a vacuum chamber for optically trapping and cooling said predetermined species of atoms;

sealing said vacuum chamber and creating a vacuum therein;

introducing into said vacuum chamber a source of said predetermined species of atoms to form said vapor of said predetermined species of atoms;

generating a plurality of laser beams for use in cooling said predetermined species of atoms from said vapor of said predetermined species of atoms;

directing each of said plurality of laser beams into said vacuum chamber from a different angle relative to a target area inside said vacuum chamber such that said target area has a net light pressure area of zero.

13. The method of claim 12, wherein said step of directing includes pointing each of said plurality of laser beams at said target area.

14. The method of claim 12, wherein said step of generating said plurality of laser beams is accomplished using laser diodes.

15. The method of claim 12, wherein said predetermined species of atoms are atoms of cesium.

16. The method of claim 12, wherein said predetermined species of atoms are atoms of of rubidium.

17. The method of claim 12, wherein said step of directing each of said plurality of laser beams into said vacuum chamber comprises the step of directing said plurality of laser beams into said vacuum chamber along said different angles relative to said target area.

18. The method of claim 12, wherein said step of introducing said predetermined species of atoms into said vacuum chamber comprises the step of maintaining said source of predetermined species of atoms at ambient or lower temperature.

19. The method of claim 12, wherein said vapor of said predetermined species of atoms is concentrated at said target area.

20. The method of claim 12, further including the step of cooling said vapor of said predetermined atoms in said vacuum chamber to a temperature of 10 degrees microKelvin or less.

21. The method of claim 12, further including the step of changing the frequency of at least one of said plurality of laser beams in at least one direction such that said light pressure in said target area becomes nonuniform in said at least one direction.

22. The method of claim 21, wherein said step of changing the frequency of said at least one of said plurality of laser beams utilizes at least one of two movable mirrors and acousto-optical modulators.

23. A precision frequency standard, comprising:

an optical trap for optically trapping and cooling a predetermined species of atoms from an ambient or lower temperature vapor, said optical trap comprising:

a sealed vacuum chamber for optically trapping and cooling said predetermined species of atoms from said vapor;

means for introducing said predetermined species of atoms into said vacuum chamber;

means for generating a plurality of laser beams;

means for directing each of said plurality of laser beams into said vacuum chamber from a different angle relative to a target area inside said vacuum chamber such that said target area has a net light pressure of zero; and means for changing the frequency of at least one of said plurality of laser beams in at least one direction such that said light pressure in said target area becomes nonuniform in said at least one direction;

means for ejecting the optically trapped and cooled atoms from said optical trap;

means for exciting the ejected atoms, said means for exciting comprising an oscillator;

means for measuring a fraction of atoms excited by said means for exciting;

means for comparing said fraction of excited atoms with atoms that have not been excited; and means for adjusting said oscillator to maximize said fraction of atoms being excited.

24. The precision frequency standard of claim 22, wherein said ejecting means comprises means for shifting the frequency of light in said optical trap along at least one axis of said optical trap.

25. The precision frequency standard of claim 22, wherein said means for exciting the ejected atoms is positioned at an end of one axis of said optical trap.

26. The precision frequency standard of claim 23, further including a magnetic confinement means for guiding the atoms between said exciting means and said measuring means.

27. A precision frequency standard for use in microgravity conditions, comprising:

an optical trap for optically trapping and cooling a predetermined species of atoms from an ambient or lower temperature vapor, said optical trap comprising:

a sealed vacuum chamber for optically trapping and cooling said predetermined species of atoms from said vapor;

means for introducing said predetermined species of atoms into said vacuum chamber;

means for generating a plurality of laser beams; and means for directing each of said plurality of laser beams into said vacuum chamber from a different angle relative to a target area inside said vacuum chamber such that said target area has a net light pressure of zero;

means for creating an expanding cloud of said predetermined species of atoms at said target area of said optical trap;

means for exciting said atoms in said expanding cloud of predetermined species of atoms, said means for exciting comprising an oscillator;

means for measuring a fraction of atoms excited by said means for exciting;

means for comparing said fraction of excited atoms with atoms that have not been excited; and means for adjusting said oscillator to maximize said fraction of atoms being excited.

28. A precision frequency standard, comprising:

an optical trap for optically trapping and cooling a predetermined species of atoms from a vapor, said optical trap comprising:

a sealed vacuum chamber for optically trapping and cooling said predetermined species of atoms from said vapor;

means for introducing said predetermined species of atoms into said vacuum chamber;

means for generating a plurality of laser beams; and means for directing each of said plurality of laser beams into said vacuum chamber from a different angle relative to a target area inside said vacuum chamber such that said target area has a net light pressure of zero;

means for releasing the optically trapped and cooled atoms from said optical trap;

means for exciting the released atoms, said means for exciting comprising an oscillator;

means for measuring a fraction of atoms excited by said means for exciting;

means for comparing said fraction of excited atoms with atoms that have not been excited; and means for adjusting said oscillator to maximize said fraction of atoms being excited.

29. The precision frequency standard of claim 28, wherein said means for exciting the released atoms comprises first and second exciting means.

30. The precision frequency standard of claim 29, further including magnetic confinement means for guiding said atoms between said first exciting means, said second exciting means and said measurement means.

31. The precision frequency standard of claim 28, wherein said means for exciting the released atoms is positioned at two ends of said optical trap along one axis of said optical trap.

32. The precision frequency standard of claim 28, further including a magnetic confinement means for guiding the atoms between said exciting means and said measuring means.

33. A method of forming a precision frequency standard, comprising the steps of:

forming a vacuum chamber for optically trapping and cooling a predetermined species of atoms;

sealing said vacuum chamber and creating a vacuum therein;

introducing into said vacuum chamber a source of said predetermined species of atoms in the form of an ambient or lower temperature vapor of said species of atoms;

generating a plurality of laser beams for use in cooling said predetermined species; and directing each of said plurality of laser beams into said vacuum chamber from a different angle relative to a target area inside said vacuum chamber such that said target area has a net light pressure of zero;

creating an expanding cloud of said predetermined species of atoms at said target area of said optical trap;

exciting said atoms in said expanding cloud of predetermined species of atoms using an oscillator;

measuring a fraction of said excited atoms;

comparing said fraction of excited atoms with atoms that have not been excited; and adjusting said oscillator to maximize said fraction of excited atoms.

34. A method of forming a precision frequency standard, comprising the steps of:

forming a vacuum chamber for optically trapping and cooling a predetermined species of atoms;

sealing said vacuum chamber and creating a vacuum therein;

introducing into said vacuum chamber a source of said predetermined species of atoms in the form of an ambient or lower temperature vapor of said species of atoms;

generating a plurality of laser beams for use in cooling said predetermined species; and directing each of said plurality of laser beams into said vacuum chamber from a different angle relative to a target area inside said vacuum chamber such that said target area has a net light pressure of zero;

releasing said optically trapped and cooled atoms from said target area;

exciting said released atoms using an oscillator;

measuring a fraction of said excited atoms;

comparing said fraction of excited atoms with atoms that have not been excited; and adjusting said oscillator to maximize said fraction of excited atoms.

35. The method of claim 34, wherein said step of exciting said released atoms includes the step of using two exciting means spaced apart from each other.

36. The method of claim 35, further including the step of magnetically guiding said excited atoms between said two spaced apart exciting means prior to performing said measuring step.

37. The method of claim 34, further including the step of magnetically guiding said excited atoms prior to performing said measuring step.

38. An optical trap for optically trapping and cooling a predetermined species of atoms from an ambient or lower temperature non-directional vapor, comprising;

a sealed vacuum chamber for optically trapping and cooling said pre-determined species of atoms from said ambient or lower temperature non-directional vapor;

a source of said ambient or lower temperature vapor of said predetermined species of atoms;

means for generating a plurality of laster beams; and means for directing each of said plurality of laser beams into said vacuum chamber from a different angle relative to a target area inside said vacuum chamber such that said target area has a net light pressure of zero.

* * * * *

UNITED STATES PATENT AND TRADEMARK OFFICE

CERTIFICATE OF CORRECTION

PATENT NO. : 5,528,028
DATED : June 18, 1996
INVENTOR(S) : Chu et al.

It is certified that error appears in the above-indentified patent and that said Letters Patent is hereby corrected as shown below:

IN THE OTHER PUBLICATIONS:

Page 2, col. 1, line 8, after "Frequency" insert --Control--.

Col. 3, line 46, change "need the" to --the need--.

Col. 5, line 26, after "means" insert --of--;
line 59, delete "by".

Col. 6, line 57, change "De Marchi" to --DeMarchi--.

Col. 7, line 5, change "2/2" to --$\lambda/2$--.

Col. 10, line 9, after "invention" insert --is--;
line 48, after "frequency" insert --on--.

Col. 11, line 6, change "acoustooptic" to --acousto-optic--;
line 52, after "four" insert --similar--.

UNITED STATES PATENT AND TRADEMARK OFFICE

CERTIFICATE OF CORRECTION

PATENT NO. : 5,528,028
DATED : June 18, 1996
INVENTOR(S) : Chu et al.

It is certified that error appears in the above-indentified patent and that said Letters Patent is hereby corrected as shown below:

IN THE CLAIMS:

Claim 5, line 2, delete "of" (third occurrence).

Claim 9, line 3, change "microKelvin" to --microkelvin--.

Claim 16, line 2, delete "of" (third occurrence).

Claim 20, line 4, change "microKelvin" to --microkelvin--.

Claim 24, line 1, change "22" to --23--.

Claim 25, line 1, change "22" to --23--.

Col. 18, claim 38, line 1, change "laster" to --laser--.

Signed and Sealed this

Seventeenth Day of June, 1997

Bruce Lehman

*Attest:*

BRUCE LEHMAN

*Attesting Officer*

*Commissioner of Patents and Trademarks*